US005183066A

United States Patent [19]

Hethcoat

[11] Patent Number: 5,183,066

[45] Date of Patent: Feb. 2, 1993

[54] SPRAY NOZZLE CLEANING APPARATUS AND METHOD

[75] Inventor: Gary L. Hethcoat, Ontario

[73] Assignee: General Dynamics Corp., Air Defense Systems Division, Pomona, Calif.

[21] Appl. No.: 679,493

[22] Filed: Apr. 2, 1991

[51] Int. Cl.[5] ..... B08B 3/02

[52] U.S. Cl. ..... 134/54; 134/102.2; 134/166 C; 134/200

[58] Field of Search ..... 134/44, 56 R, 102, 166 C, 134/169 C, 52, 53, 54, 55, 200, 183

[56] References Cited

U.S. PATENT DOCUMENTS

| | | | |
|---|---|---|---|
| 647,182 | 4/1900 | Garand | 134/44 |
| 1,789,440 | 1/1931 | Hyatt | 134/44 |
| 2,268,721 | 1/1942 | Ossowsky | 134/55 X |
| 2,370,775 | 3/1945 | Capita | 134/44 X |
| 3,092,120 | 6/1963 | Hilger et al. | 134/55 X |
| 3,601,135 | 8/1971 | Marolow et al. | 134/102 |
| 3,771,539 | 11/1973 | De Santis | 134/111 |
| 3,876,144 | 8/1975 | Madden et al. | 239/106 |
| 4,025,363 | 5/1977 | De Santis | 134/102 |
| 4,433,698 | 2/1984 | Blaul | 134/102 |
| 4,785,836 | 11/1988 | Yamamoto | 134/56 |
| 4,791,946 | 12/1988 | Cavanaugh et al. | 134/99 |
| 4,823,820 | 4/1989 | Larson et al. | 134/169 C X |
| 4,830,882 | 5/1989 | Ichinose et al. | 427/421 |
| 4,881,561 | 11/1989 | Schwarzwalder | 134/76 |
| 4,934,393 | 6/1990 | Lighthall | 134/102 X |

*Primary Examiner*—Frankie L. Stinson

*Attorney, Agent, or Firm*—Leo R. Carroll; Neil F. Martin

[57] ABSTRACT

Apparatus for cleaning paint spray gun nozzles automatically includes a housing having separate cleaning and reservoir chambers separated by a dividing wall, and a cleaning spray head in the cleaning chamber for directing a spray of cleaning fluid at a nozzle in the chamber. A supply of cleaning fluid in the reservoir is connected to the cleaning spray head by a supply tube. The cleaning chamber has an entrance for receiving a spray gun nozzle, and a supply of gas under pressure is connected to the reservoir chamber automatically on detection of entry of a spray gun nozzle through the entrance, to urge cleaning fluid from the reservoir into the supply tube. A passageway is provided in the dividing wall for returning used cleaning fluid to the reservoir. The supply of gas to the reservoir is cut off automatically at the end of a cleaning cycle on removal of the cleaned nozzle from the chamber.

15 Claims, 2 Drawing Sheets

SPRAY NOZZLE CLEANING APPARATUS AND METHOD

BACKGROUND OF THE INVENTION

The present invention relates to an apparatus and method for automatically cleaning the nozzles of spray guns or fluid delivery guns of the type used for spraying paint and similar materials.

Paint spray guns typically build up deposits of paint on their nozzles over a period of time, and must periodically be cleaned with suitable solvents or cleaning materials to prevent clogging. The vapors produced by such cleaning materials are hazardous, and exposure of workers to such vapors must be limited. In industries such as automobile production, an automatic painting apparatus is employed to apply a coating of paint to articles such as automobiles from a plurality of spray guns. Manual cleaning of such spray guns by workers at periodic intervals is both hazardous and expensive. Additionally, there is a problem with the safe disposal of used cleaning materials which pose an environmental hazard.

One known method and apparatus for cleaning paint spray guns of the type used in painting automobiles is described in U.S. Pat. No. 4,830,882 of Ichinose, et al. In this apparatus, the paint spray head or nozzle is inserted into a cleaning chamber opening, and is sprayed with solvent from several cleaner heads. Used solvent is discharged through an outlet at the bottom of the cleaning chamber.

SUMMARY OF THE INVENTION

It is an object of this invention to provide a new and improved apparatus and method for cleaning the nozzles of spray or liquid dispensing guns.

According to one aspect of the present invention, a cleaning apparatus for spray gun nozzles is provided, which comprises a first, cleaning chamber having an entrance for receiving the nozzle of a spray gun in a cleaning position in the chamber, at least one cleaning head in the chamber directed at the cleaning position for ejecting a spray of cleaning material at a nozzle in that position, a second, reservoir chamber for containing a supply of cleaning material, a connecting passageway between the material in the reservoir chamber and the cleaning head for supplying cleaning material to the cleaning head, a pressurization device connected to the reservoir chamber to pressurize the chamber and urge cleaning material out of the chamber and into the cleaning head, a detector for detecting the entry of a spray gun nozzle through the first chamber entrance, and the pressurization device being responsive to the detector to pressurize the reservoir chamber automatically on entry of the spray gun nozzle into the cleaning chamber.

Preferably, a second connecting passageway between the cleaning chamber and reservoir chamber allows used cleaning fluid or solvent to return to the reservoir chamber for reuse. A filter or screen is provided for filtering used cleaning fluid to remove solid particles before return to the reservoir chamber. A return valve is preferably provided to close the second connecting passageway during the cleaning procedure, the valve being opened automatically upon removal of the cleaned nozzle from the chamber. The entrance to the cleaning chamber is preferably closed by a spring loaded door when the chamber is not in use, the door being urged open on entry of a spray nozzle into the chamber. A suitable seal is provided at the entrance for sealing against the spray gun and preventing or reducing the loss of solvent vapors from the cleaning chamber.

In a preferred embodiment of the invention, the pressurization device comprises a supply of gas such as air and a connecting line connecting the supply to the reservoir chamber. A valve is provided in the connecting line, and the detector for detecting entry of a spray nozzle into the cleaning chamber comprises an actuating arm connected to the door and positioned to bias the gas supply valve into an open position when the door is opened. The gas supply valve is biassed into a closed position when the door closes on removal of a cleaned nozzle, cutting off the gas supply to the reservoir chamber and thus turning off the cleaning fluid spray. At the same time, the return valve opens allowing used cleaning fluid to return to the reservoir chamber.

With this arrangement, cleaning materials such as paint solvents are conserved for re-use over several cleaning cycles. Preferably, the spray nozzle to be cleaned is moved automatically by the standard robot arm as used in automatic spraying devices into the cleaning chamber, and is left there over a predetermined time period sufficient to dispense all of the material from the reservoir chamber through the cleaning spray head and to subsequently exhaust gas or air from the cleaning spray head to dry the nozzle before removal. On expiry of the predetermined time period, the spray gun nozzle is moved out of the cleaning chamber by the robot arm, and the return valve opens to allow the solvent to return to the reservoir chamber for subsequent use. A drain outlet is provided in the reservoir chamber to permit draining of cleaning material from the chamber at intervals, for example when it is no longer useful or at the end of each day, after which new cleaning material is supplied to the reservoir.

This apparatus will reduce equipment down time for cleaning and will improve paint finish quality since it allows more frequent cleaning of spray gun nozzles, so that they will operate more efficiently. It is of a simple, low maintenance design and reduces quantities of hazardous waste by re-using cleaning solvents until they are no longer suitable for use, rather than using a new supply of solvent for each cleaning procedure.

BRIEF DESCRIPTION OF THE DRAWINGS

The invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
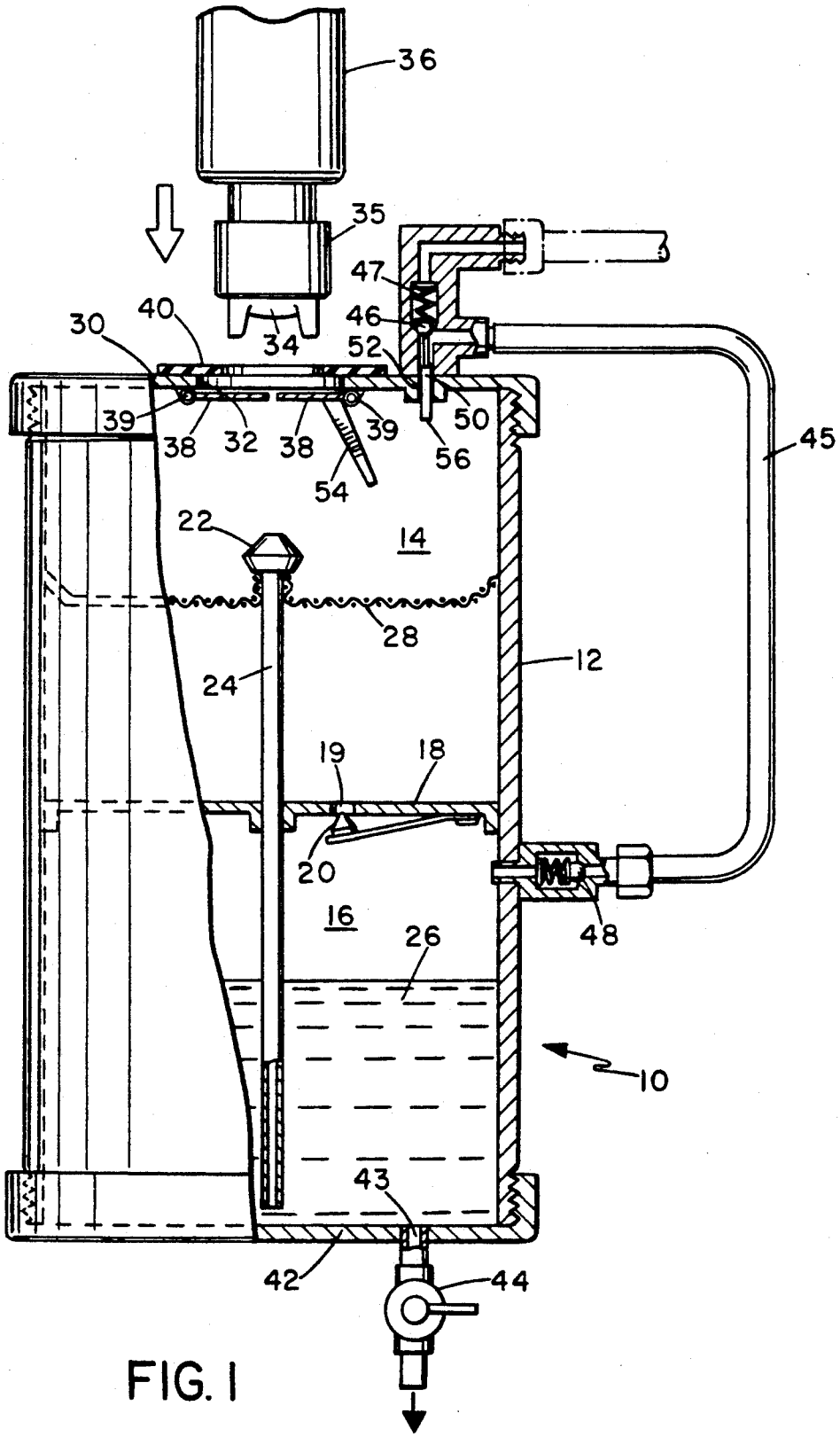
FIG. 1 is a side elevation view of the spray nozzle cleaning unit, according to a preferred embodiment of the invention, with portions cut away, showing the unit ready to receive a spray nozzle.
Figure 2:
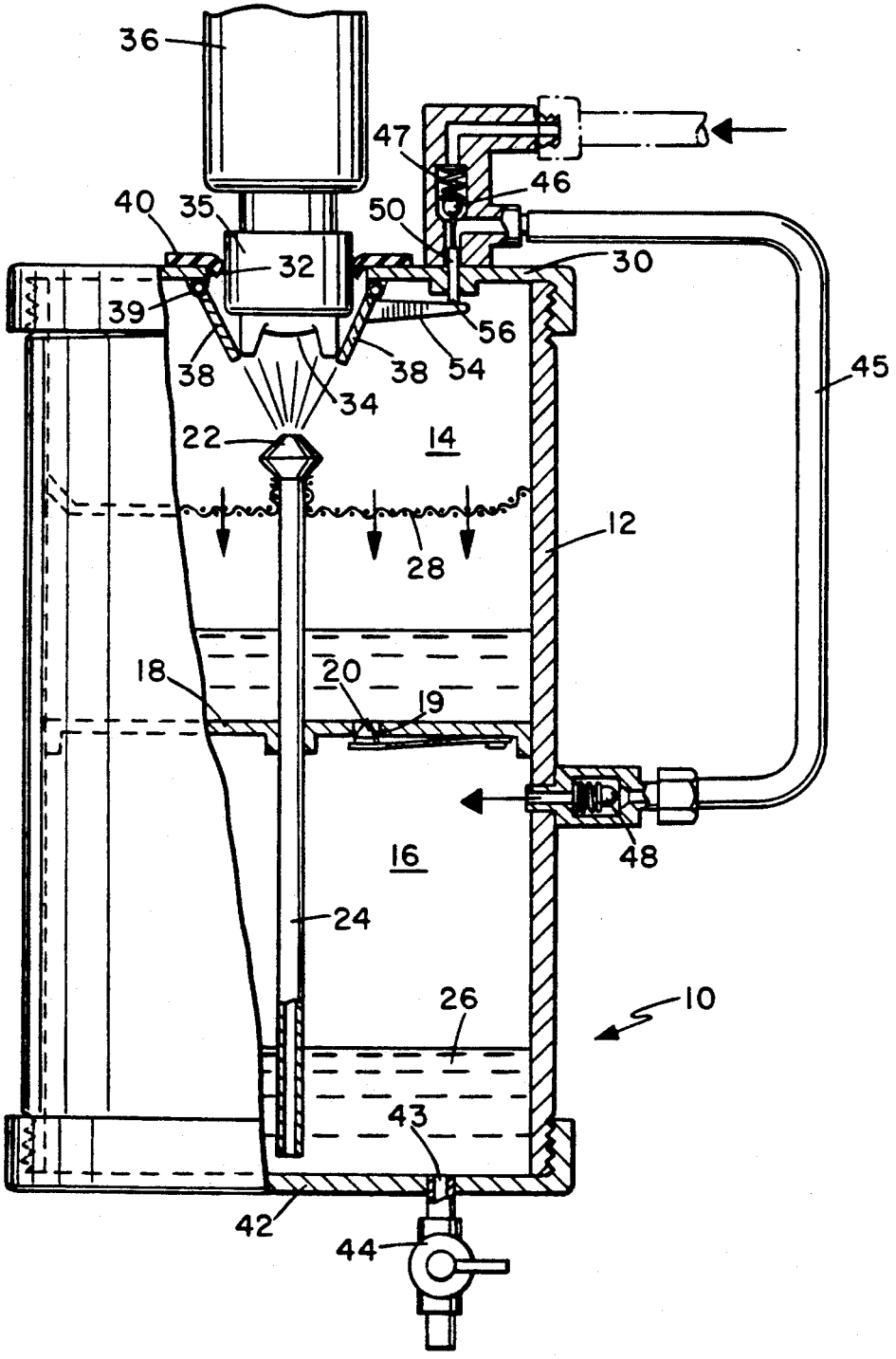
FIG. 2 is a similar view with the spray nozzle in place and the cleaning unit in operation.

As illustrated in FIGS. 1 and 2 of the drawings, the spray nozzle cleaning apparatus 10 according to a preferred embodiment of the present invention basically comprises a cylindrical outer housing or casing 12 having upper and lower inner chambers 14, 16 separated by a dividing wall 18 which is suitably welded, brazed or mechanically pressed into the wall of casing 12. An opening 19 is provided in wall 18 connecting the upper and lower chambers, and a reed valve 20 is provided for closing the opening when the lower chamber is pressurized, as explained in more detail below. Under normal, inoperative conditions as illustrated in FIG. 1 the reed valve 20 is spring loaded away from the opening 19. Opposite ends of the casing 12 are closed by removable end caps 30 and 42.

At least one solvent or cleaning material spray head 22 is mounted in upper chamber 14, and is connected to the lower chamber 16 via a downwardly depending connecting passageway or supply tube 24 extending through dividing wall 18. A supply of solvent or cleaning fluid 26 is contained within the lower chamber 16, which is a reservoir. A catch or filter screen 28 is secured around the solvent spray head 22 and suitably secured to the wall of the casing 12.

Removable upper end cap 30 has a central entrance opening 32 sized to receive the nozzle 34 of a spray gun 36 for spraying paint and like materials. The opening 32 is normally closed by spring loaded hinged doors 38 when the apparatus is not in use, as illustrated in FIG. 1, the doors having spring hinges 39 urging them into the closed position of FIG. 1. Annular seal member or gasket 40 is mounted on the top of end cap 30 around and centered on opening 32. Seal member or gasket 40 has an opening of smaller diameter than that of opening 32, and the gasket opening is designed for sealing engagement with the air cap 35 of spray gun 36, as best illustrated in FIG. 2.

Lower end cap 42 has a drain opening 43 normally closed by drain valve 44. A supply of pressurized gas or air (not illustrated) is connected to the lower chamber or reservoir via connecting line 45. A check valve 48 is located in connecting line 44 at the entrance to reservoir 16 to prevent back flow of solvent into the line. A spring loaded valve member 46 is located in connecting line 44 and is urged by biassing spring 47 into the position illustrated in FIG. 1 in which gas supply to the reservoir is cut off. A valve stem or pin 50 projecting downwardly from valve member 46 is slidably mounted in a through bore 52 extending from valve member 46 through end cap 30. An actuator or detector arm 54 is secured to one of the spring loaded doors at the entrance arm and is arranged to move on opening of the doors into engagement with the projecting end 56 of pin 50, urging the pin upwardly and opening valve 46 to allow air flow into reservoir 16.

The apparatus is intended to be used in conjunction with a robotic painting station in which a number of robotic manipulator arms with attached spray guns move to spray paint automatically on the surface of an object to be painted, such as a missile section, automobiles, aircraft, machine parts, and other items which can be painted by a robot. However, it may be used with any spray guns. The casing can be mounted to the spray booth wall or waste funnel within range of the robotic arm or arms, and the arms may be programmed to move the attached spray guns automatically into the cleaning apparatus at periodic intervals.

When it is time to clean a spray gun, the robot manipulator arm moves the spray gun to insert the end or nozzle of the spray gun through the entrance opening at the top of casing 12 until the air cap 35 projects through the seal 40, as illustrated in FIG. 2. This motion depresses the doors 38 and urges them open, simultaneously raising actuator arm 54 to push pin 50 upwardly, opening valve 46. Air is then supplied to the reservoir or chamber 16, pressurizing the space above the solvent supply 26 and urging the reed valve 20 to close, isolating the upper chamber from the lower chamber. At the same time, solvent 26 is forced up the supply tube 24 and ejected through spray head 22, which is directed towards the spray gun nozzle 34, as illustrated in FIG. 2.

The solvent spray dislodges any solid matter which may be clogging nozzle 34, and the used solvent and solid matter fall down onto screen 28, which will retain the solid matter. Loss of solvent vapor to the atmosphere is reduced or prevented by the seal 40 which seals the chamber entrance. Most or all of the used solvent flows through the screen onto dividing wall 18 where it collects during the cleaning process. After all the solvent in the lower chamber is exhausted, air blows through the spray head 22, drying the gun air cap and nozzle before removal. After a predetermined cleaning time interval sufficient to spray all the solvent from the lower chamber and to blow air onto the nozzle, the robotic arm is activated to remove the spray gun nozzle from the cleaning apparatus. As the nozzle is lifted out of the entrance opening, the doors 38 will close automatically, lowering the end of actuator arm 54 away from valve stem 50. Valve 46 is then biassed into its closed position, cutting off the air supply to the lower chamber. The pressure in the lower chamber will reduce until it is insufficient to hold the reed valve 20 closed, and the reed valve spring tension is sufficient to urge the reed valve 20 away from opening 19, allowing used solvent to flow back into the lower chamber for re-use.

When the solvent has been re-used several times and is no longer useful, or alternatively at the end of a predetermined period such as the end of each day, drain valve 44 is opened to allow the spent solvent to flow to a robotic hazardous waste catch container of the type which is normally used with robotic paint spraying stations to retain the waste fluid from line flushing. Clean solvent is then supplied to reservoir 16, ready for the next cleaning cycle.

This apparatus allows a painting robot to clean the electrostatic or conventional spray gun during or at the end of a program without human intervention, using a minimal amount of cleaning solvent within a sealed system to prevent or reduce the amount of vapor escaping into the earth's atmosphere. This reduces equipment down time for cleaning and will improve the quality of a finished paint job since the spray gun can be cleaned repeatedly during a shift so that it will always operate at full or close to full efficiency, avoiding the problems of manually operated spray gun cleaning systems. The apparatus is simple and inexpensive, requiring only one air line for operation, and is maintenance free other than draining and re-filling once a day. This apparatus reduces the amount of hazardous waste in the environment since cleaning solvent is used a number of times before being replaced with new solvent.

Although a preferred embodiment of the invention has been described above by way of example only, it will be understood by those skilled in the field that modifications may be made to the disclosed embodiment without departing from the scope of the invention, which is defined by the appended claims.

I claim:

1. A cleaning apparatus for cleaning spray gun nozzles, comprising:

a first, cleaning chamber having an entrance for receiving the nozzle of a spray gun into a cleaning position in said chamber;

seal means at the entrance to said first chamber for sealing engagement with part of a spray gun when the nozzle of the spray gun projects into the first chamber;

at least one cleaning spray head in said cleaning chamber directed at the cleaning position;

a second, reservoir chamber for holding a supply of cleaning fluid;

a first connecting passageway between the reservoir chamber and the cleaning head for delivery of cleaning fluid to the cleaning head;

a gas supply line connected to the reservoir chamber for supplying gas under pressure to the reservoir chamber to force cleaning fluid from the reservoir chamber to the cleaning head;

a valve in the supply line moveable between closed and open positions for controlling the connection of the gas supply to the reservoir chamber;

an actuating arm associated with the valve and moveable between inoperative and operative positions to move the valve between the closed and open positions; and the actuating arm being positioned in the cleaning chamber adjacent the entrance and being moveable between the inoperative and operative positions in response to movement of a spray nozzle into the cleaning chamber.

2. The apparatus as claimed in claim 1, including at least one door for normally closing the entrance to said first cleaning chamber, and a spring urging said door into its closed position, said door being opened on urging of a spray nozzle through said entrance, and said actuating arm being operatively linked to said door for movement into said operative position on opening of said door and movement into said inoperative position on closing of said door.

3. The apparatus as claimed in claim 1, wherein said seal means comprises an annular seal member having a central opening of diameter less than the diameter of a spray gun air cap.

4. A cleaning apparatus for cleaning spray gun nozzles, comprising:

a first, cleaning chamber having an entrance for receiving the nozzle of a spray gun into a cleaning position in said chamber;

at least one cleaning spray head in said cleaning chamber directed at the cleaning position;

a second, reservoir chamber for holding a supply of cleaning fluid;

a first connecting passageway between the reservoir chamber and the cleaning head for delivery of cleaning fluid to the cleaning head;

a gas supply line connected to the reservoir chamber for supplying gas under pressure to the reservoir chamber to force cleaning fluid from the reservoir chamber to the cleaning head;

a valve in the supply line moveable between closed and open positions for controlling the connection of the gas supply to the reservoir chamber;

an actuating arm associated with the valve and moveable between inoperative and operative positions to move the valve between the closed and open positions;

the actuating arm being positioned in the cleaning chamber adjacent the entrance and being moveable between the inoperative and operative positions in response to movement of a spray nozzle into the cleaning chamber; and a second connecting passageway between said first and second chambers for returning spent cleaning fluid to the reservoir chamber at the end of a cleaning cycle, and valve means in said second connecting passageway for closing said passageway during a cleaning cycle.

5. The apparatus as claimed in claim 4, including filter means between said first and second chambers for filtering solid material from said spent cleaning fluid prior to return to said second chamber.

6. The apparatus as claimed in claim 4, including a single unitary housing having an internal dividing wall separating an upper part of said housing comprising said first chamber from a lower part of said housing comprising said second chamber, said dividing wall having an opening comprising said second passageway, and said valve means comprising a valve member in said second chamber for closing said opening when said chamber is pressurized, and biasing means for urging said valve member away from said opening when gas supply to said chamber is cut off.

7. The apparatus as claimed in claim 6, wherein said housing has at least one removable end cap comprising one end wall of said housing.

8. An apparatus for automatically cleaning a spray nozzle, comprising:

a first chamber having an entrance for entry of a spray nozzle only of a spray gun into a cleaning position in the chamber with the remainder of the spray gun projecting out of the chamber;

a cleaning head in the first chamber for directing a spray of cleaning fluid at the cleaning position;

a second chamber containing a supply of cleaning fluid;

a first passageway connecting the supply of cleaning fluid in the second chamber to the cleaning head;

a second passageway connecting the first chamber to the second chamber for re-cycling used cleaning material back to the second chamber;

valve means for controlling the supply of cleaning fluid to the cleaning head;

detector means adjacent said entrance for detecting movement of a spray nozzle through said entrance into the first chamber; and linking means for linking said detector means to said valve means for automatically opening said valve means to dispense fluid from said cleaning head on entry of a spray nozzle into said first chamber.

9. Apparatus as claimed in claim 8, including a gas supply line connected to said second chamber for supplying gas under pressure to said second chamber to force cleaning fluid out of said chamber and into the cleaning head, said valve means being located in said gas supply line.

10. Apparatus as claimed in claim 8, wherein said first and second chambers comprise separate upper and lower chambers of a single, unitary housing having a dividing wall separating said upper and lower chambers, said housing having at least one removable end cap comprising one end wall of said housing.

11. Apparatus as claimed in claim 8, including filter means in the path of used cleaning fluid between the first and second chambers for filtering solid particles from used cleaning fluid.

12. Apparatus as claimed in claim 11, wherein said filter means comprises a catch screen extending from said cleaning head to the peripheral wall of said first chamber.

13. An apparatus for automatically cleaning a spray nozzle, comprising:

a first chamber having an entrance for entry of a spray nozzle into a cleaning position in the chamber;

a cleaning head in the first chamber for directing a spray of cleaning fluid at the cleaning position;

a second chamber containing a supply of cleaning fluid;

a first passageway connecting the supply of cleaning fluid in the second chamber to the cleaning head;

a second passageway connecting the first chamber to the second chamber for re-cycling used cleaning material back to the second chamber;

valve means for controlling the supply of cleaning fluid to the cleaning head;

detector means for detecting the entry of a spray nozzle into the first chamber;

linking means for linking said detector means to said valve means for automatically opening said valve means to dispense fluid from said cleaning head on entry of a spray nozzle into said first chamber; and said detector means comprising barrier means for normally closing said entrance, said barrier means being moveable into an open position on urging of a spray gun nozzle through said entrance.

14. Apparatus as claimed in claim 13, wherein said linking means comprises an actuator arm secured to said barrier means and moveable on opening said barrier means between an inoperative position and an operative position urging said valve means into an open position.

15. An apparatus for automatically cleaning a spray nozzle, comprising:

a first chamber having an entrance for entry of a spray nozzle into a cleaning position in the chamber;

a cleaning head in the first chamber for directing a spray of cleaning fluid at the cleaning position;

a second chamber containing a supply of cleaning fluid;

a first passageway connecting the supply of cleaning fluid in the second chamber to the cleaning head;

a second passageway connecting the first chamber to the second chamber for recycling used cleaning material back to the second chamber;

valve means for controlling the supply of cleaning fluid to the cleaning head;

detector means for detecting the entry of a spray nozzle into the first chamber;

linking means for linking said detector means to said valve means for automatically opening said valve means to dispense fluid from said cleaning head on entry of a spray nozzle into said first chamber; and second valve means in said second passageway for closing said passageway when said first-mentioned valve means is open, and biassing means for urging said second valve means into an open position when said first-mentioned valve means is closed.

* * * * *